US006723969B1

(12) United States Patent
Beatson

(10) Patent No.: US 6,723,969 B1
(45) Date of Patent: Apr. 20, 2004

(54) ELECTRICAL HEATING ELEMENTS FOR EXAMPLE MADE OF SILICON CARBIDE

(75) Inventor: John George Beatson, Perth (GB)

(73) Assignee: Kanthal Limited (GB)

( * ) Notice: Subject to any disclaimer, the term of this patent is extended or adjusted under 35 U.S.C. 154(b) by 0 days.

(21) Appl. No.: 10/149,104

(22) PCT Filed: May 26, 2000

(86) PCT No.: PCT/GB00/02041

§ 371 (c)(1),
(2), (4) Date: Oct. 7, 2002

(87) PCT Pub. No.: WO01/43505

PCT Pub. Date: Jun. 14, 2001

(30) Foreign Application Priority Data

Dec. 6, 1999 (GB) ..... 9928821

(51) Int. Cl.[7] ..... H05B 3/10

(52) U.S. Cl. ..... 219/553; 219/552; 219/270; 219/523; 392/497

(58) Field of Search ..... 219/553, 552, 219/270, 523, 385, 391, 420, 543, 548; 392/497, 347, 407, 441; 338/333

(56) References Cited

U.S. PATENT DOCUMENTS

| | | | | |
|---|---|---|---|---|
| 3,964,943 A | | 6/1976 | Andersen | |
| 4,080,510 A | * | 3/1978 | Beck | 219/552 |
| 4,126,757 A | | 11/1978 | Smith, Jr. et al. | |
| 4,180,697 A | | 12/1979 | Bohlander et al. | |
| 4,337,498 A | * | 6/1982 | Takahasi et al. | 219/523 |
| 4,443,361 A | * | 4/1984 | Hierholzer et al. | 219/553 |
| 5,764,850 A | * | 6/1998 | Olstad et al. | 219/552 |
| 5,965,051 A | * | 10/1999 | Hirayama et al. | 219/553 |
| 6,616,890 B2 | * | 9/2003 | McPhillips | 219/270 |

FOREIGN PATENT DOCUMENTS

| | | |
|---|---|---|
| EP | 0196957 | 10/1986 |
| GB | 845496 | 9/1958 |
| GB | 1279478 | 6/1972 |
| WO | WO 91/02438 | 2/1991 |

* cited by examiner

*Primary Examiner*—Henry Bennett
*Assistant Examiner*—Fadi H. Dahbour
(74) *Attorney, Agent, or Firm*—John S. Pratt; Dean W. Russell; Kilpatrick Stockton LLP

(57) ABSTRACT

An electrical resistance ceramic heating element comprises: a) three or more ceramic legs comprising regions of the element in which at least the majority of the electrical heating occurs (hot zones), at least one of the legs being effectively entirely a hot zone and at least two of the legs each comprising a hot zone and a cold zone; b) a number of leg terminal portions less than the number of legs, for connection to a power supply; and, c) ceramic bridging portions providing electrical connectivity between the legs.

14 Claims, 5 Drawing Sheets

ELECTRICAL HEATING ELEMENTS FOR EXAMPLE MADE OF SILICON CARBIDE

This application claims priority to Great Britain Application No. 9928821.9 filed on Dec. 6, 1999 and International Application No. PCT/GB00/02041 filed on May 26, 2000 and published in English as International Publication Number WO 01/43505 A1 on Jun. 14, 2001, the entire contents of each are hereby incorporated by reference.

FIELD OF THE INVENTION

This invention relates to electrical resistance ceramic heating elements and is particularly, although not exclusively, applicable to silicon carbide electrical heating elements.

BACKGROUND OF THE INVENTION

Electrical resistance heating is a well-known process. Electricity is passed through a resistive element that generates heat in accordance with well-known electrical laws. One group of electrical resistance heating elements comprises silicon carbide rods that have an electrical resistance varying along their length. In these elements the majority of heat generated is in high resistance parts referred to as the "hot zone", lower resistance parts where less heat is generated being referred to as "cold ends". The rods conventionally are solid rods, tubular rods, or helical cut tubular rods. The purpose of helical cutting a tubular rod is to increase the length of the electrical pathway through the hot zone, and reduce the cross-sectional area of the conductive path, and so increase the electrical resistance. Typical rods of this type are Crusilite™ Type X elements and Globar™ SG rods. Helical cut tubular rods of this nature have been known for at least forty years.

In such a tubular rod electrical connections are made at cold ends either side of the hot zone. For some purposes it is desired to have the electrical terminals at one end. Accordingly for at least 30 years it has been known to provide a tubular rod having a double helix, one end of the rod being split to provide cold end electrical terminals and the other end providing a junction between the two helixes. Typical elements of this type are the Crusilite™ DS elements and Globar™SGR or SR elements.

The current practice for Crusilite™ elements (X, MF, DS & DM) is to cut the helical groove into the silicon carbide tube using a diamond wheel. The pitch of the helix depends upon the resistance of the silicon carbide tube and the required resistance of the Crusilite™ element. The tighter the pitch, the higher the resistance obtained from a given tube. For a double helical element (DS or DM), two helical cuts are made, starting at 180° to each other and with the second helix mid-way between turns of the first helix. The helix is then extended at one end by slitting with a diamond saw, the slit end becoming the terminal end for the electrical connections.

For manufacture of the Globar™ helical element (SG, SGR), the helix is cut into the tube using a diamond drill before firing. For the double helix element (SGR) two cuts at 180° to each other are used. After cutting the helixes, the material is fired in a 2-stage process during which the final resistance is controlled.

All of these elements (Crusilite™ X, MF, DS, DM, Globar™ SG, SGR) are single-phase elements and are used in a wide range of both industrial and laboratory furnaces operating, for example, at temperatures between 1000° C. and 1600° C.

Where high levels of heating are required and the number of heater units is a multiple of three it is frequently the case that a three-phase power supply is used. It is desirable that the power in each of the three phases is the same and, for that reason, single-phase elements are normally installed in multiples of three. Alternatively, three-phase silicon carbide elements can be used, ensuring a balanced three-phase load in cases where the number of elements installed is not divisible by three. Conventionally silicon carbide three-phase electric elements consist of three legs bonded into a common bridge. The legs are normally either arranged in a plane (so the element has the appearance of cricket stumps), or arranged in a triangle (in a format sometimes referred to as a milk stool format or as a Tri-U). The cricket stump arrangement has been known since at least 1957 (see GB 845496) and the Tri-U arrangement since at least 1969. Manufacturing such elements conventionally requires separate manufacture of the legs of the element and then bonding to a bridge. It has in the past been proposed to manufacture such elements by casting in one piece but one-piece elements are not common in the market place. It has also been proposed to combine three-helically cut elements to a common bridge in cricket stump type arrangement (see GB 1279478).

It is known to combine pairs of elements in a generally U-shaped configuration so that the terminals of the elements are at one end. A typical such element is the Kanthal Type U element. (For other U-shaped elements see for example GB 838917 and U.S. Pat. No. 3,964,943). Several of these elements may be required for a given heating application. For applications where there are confined spaces it can be extremely complex to provide suitable arrangements to connect the elements to an electrical supply. Further, many holes need to be provided for the power supply to these elements. These holes can threaten the structural integrity of the thermal insulation of a heating appliance and in addition are detrimental to thermal efficiency as heat may pass out of the furnace through the holes or along the conductors. An arrangement that has been proposed is that of GB 1123606 which discloses a so-called "squirrel cage" arrangement of bar elements mounted in and spaced apart by refractory rings and interlinked by screw connection to bridging conductors. This arrangement is complex and includes many electrical interconnections.

SUMMARY OF THE INVENTION

The inventors have realised that these deficiencies may be reduced considerably by providing heating elements comprising three or more legs, a number of terminal portions less than the number of legs, and bridging portions providing electrical connectivity between the legs. The actual scope of the invention will be apparent from the accompanying claims with reference to the following description with reference to the following drawings in which:

DETAILED DESCRIPTION OF THE PREFERRED EMBODIMENTS

Figure 1:
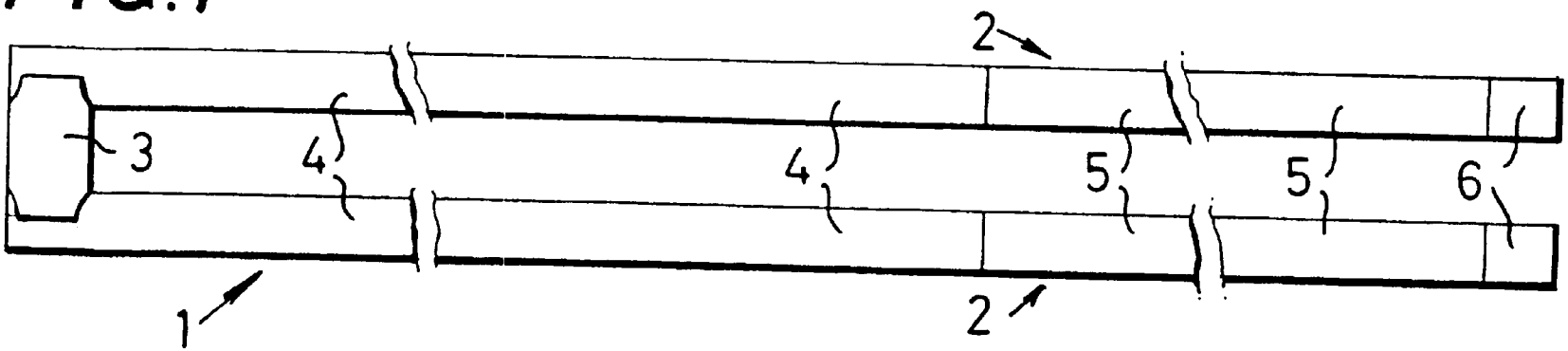
FIG. 1 is a front view of a conventional U-type element.

In FIG. 1, a conventional U-shaped element 1 is shown. Conventionally such elements are made of silicon carbide and comprise two legs 2 disposed in a plane and joined by a bridge 3. The legs 2 have portions 4 defining the hot zone of the elements and portions 5 defining the cold ends. Electrical connection is made at the ends 6 remote from the bridge 3. The provision of hot zones 4 and cold ends 5 is conventionally made by varying the electrical resistivity of the silicon carbide rods (e.g. by impregnating with silicon alloy to lower resistance). Alternatively to, or in addition to, varying the electrical resistivity, a similar effect can be achieved by varying the cross-sectional area of the legs.

Figure 2:
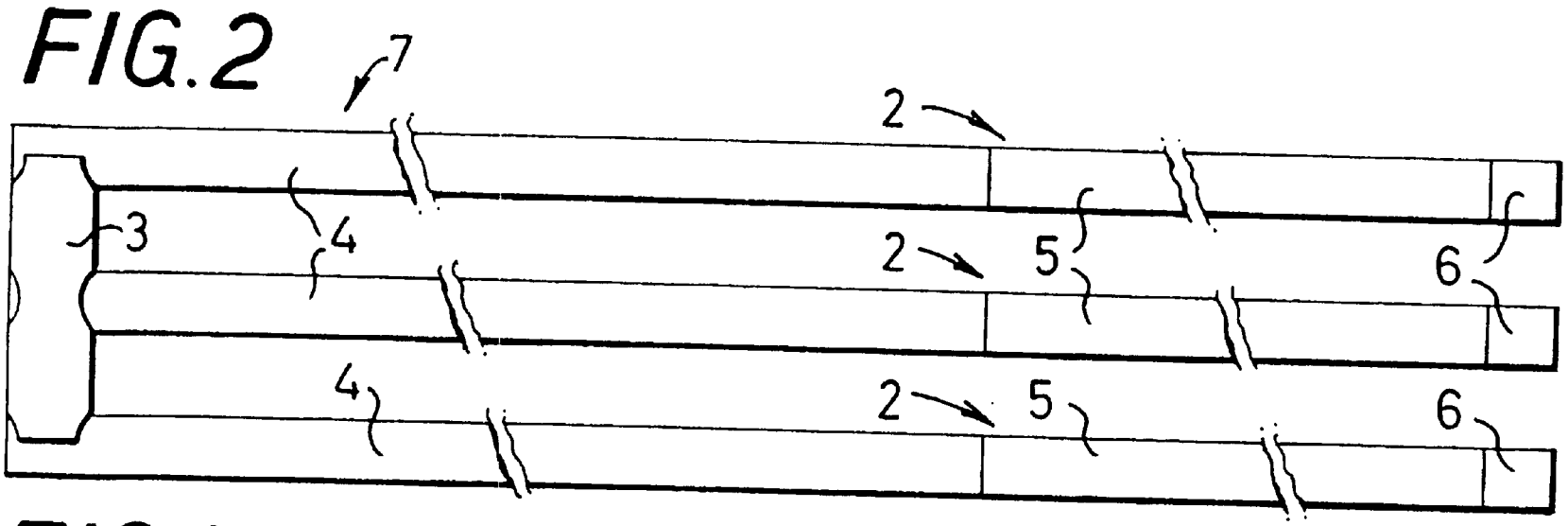
FIG. 2 is a front view of a conventional three-phase cricket stump type electrical heater element.

FIG. 2 shows a conventional three-phase cricket stump type three-phase element 7, which is made in like manner to the U-shaped element of FIG. 1.

Figure 3:
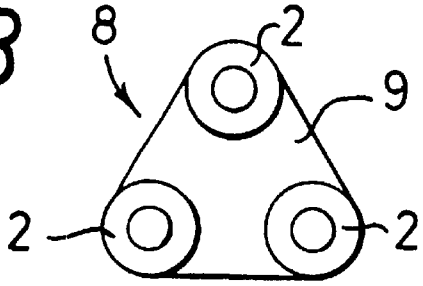
FIG. 3 is an end view of a conventional three-phase milk stool type electrical heater element.

In FIG. 3 an end view is shown of a conventional Tri-U or milk stool three-phase element 8. Such an clement is made by the same techniques as the conventional cricket stump element, but the three legs 2 are arranged side-by-side in a triangular array and joined by a bridge 9. Such an arrangement is more compact than a cricket stump arrangement.

Figure 4:
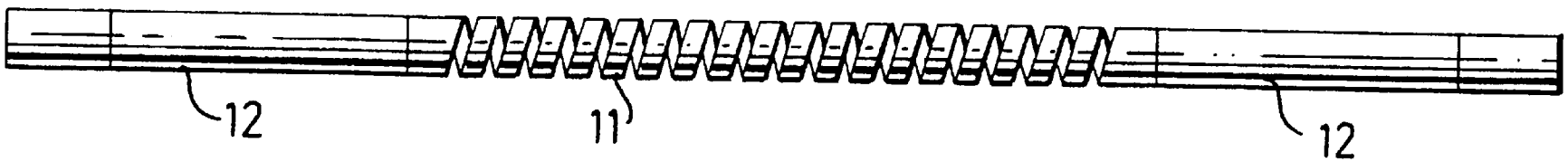
FIG. 4 is a side view of a conventional single-cut helix electrical heater element.

In FIG. 4 a side view is shown of a conventional single-phase spiral single-cut element 10. This element 10 comprises a tube of silicon carbide having a helically cut portion 11 defining the hot end of the element and uncut portions 12 defining the cold ends. The helix cut means that the hot zone 11 has a narrower electrical cross-section than an uncut tube and also has a longer effective length and so has a higher resistance than the same length of uncut tube. The material of the cold ends is conventionally identical to that of the hot zone, but its resistivity may be lowered e.g. by impregnation with silicon alloy, or bonding to a material of lower resistivity to further increase the ratio of resistance between the hot zone and cold ends.

Figure 5:
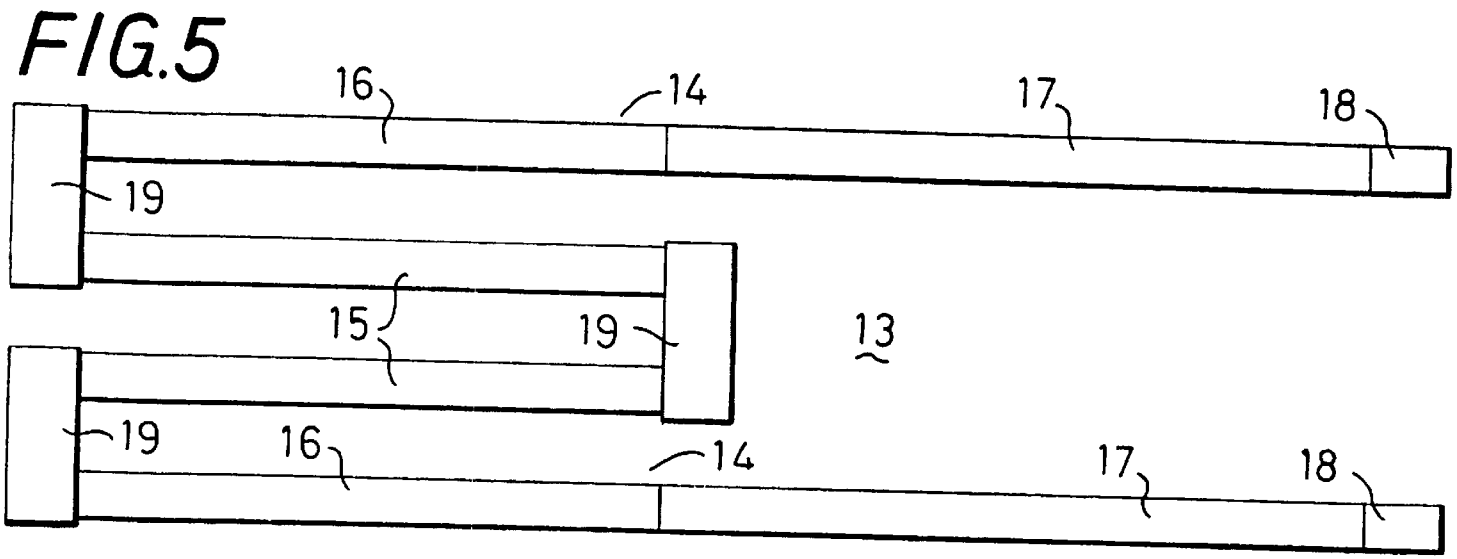
FIG. 5 is a side view of a four-legged flat electrical heater element in accordance with the principles of the present invention.
Figure 9:
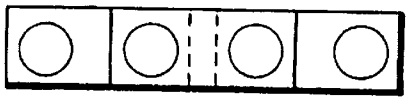
FIG. 9 is a plan view of the element of FIG. 5.

FIGS. 5 and 9 show a generally flat heater element 13 in accordance with the present invention. Four legs 14,15 are provided, legs 14 being longer than legs 15 and comprising a hot zone 16 and a cold end 17, the ends 18 of the cold ends 17 being for connection to an electrical supply. Legs 15 are entirely hot zone. Legs 14 and 15 are connected in series by bridges 19. This arrangement allows four hot zones to be incorporated in a furnace or other heating apparatus with only two terminals being required. The bridges 19 may be entirely within the insulated part of the furnace or other heating apparatus. By this means the insulation is only breached by two cold ends 17, whereas a conventional furnace comprising four single rods would be breached by eight cold ends and a furnace containing two U-type elements would be breached by four cold ends.

Figure 6:
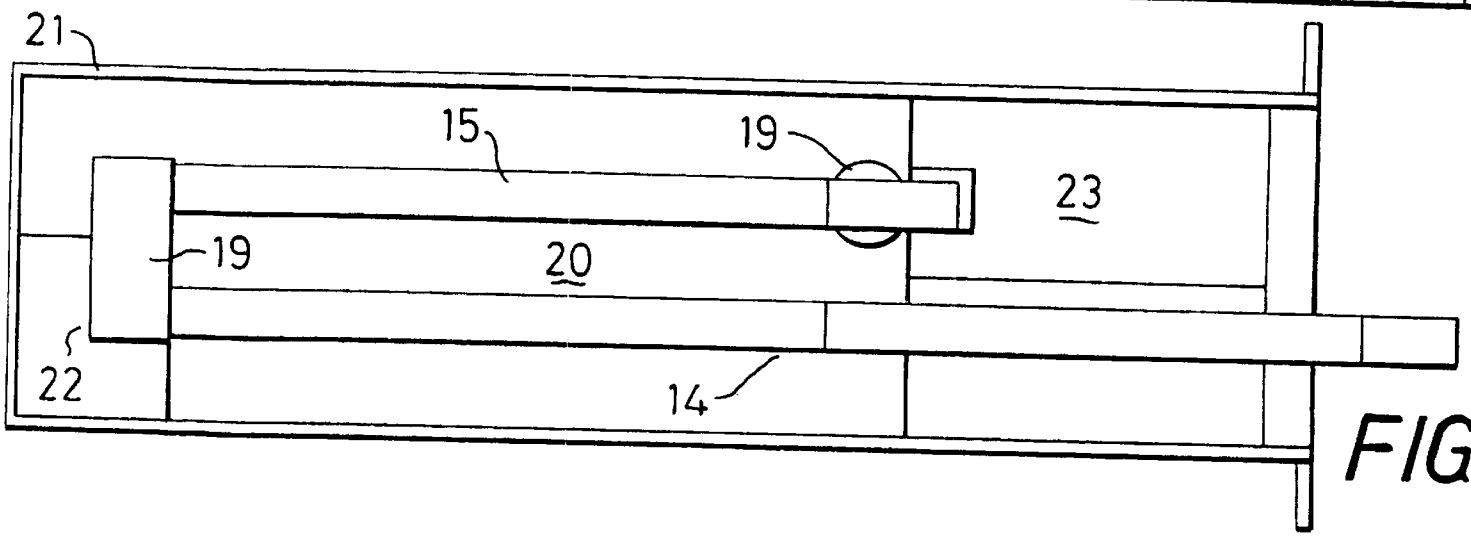
FIG. 6 is a side view of a four-legged, square array, electrical heater element in accordance with the present invention.
Figure 7:
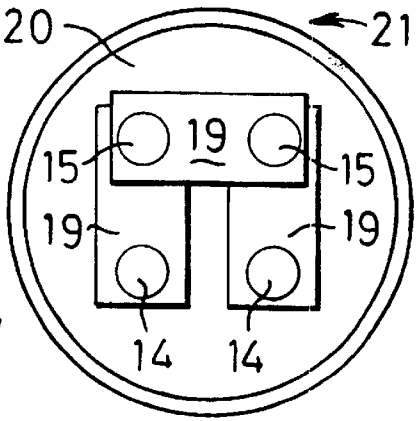
FIG. 7 is an end view of the element of FIG. 6.

In FIGS. 6 and 7 an element 20 is disclosed designed for horizontal mounting, especially but not exclusively for use in a sleeve 21. The sleeve 21 may be a tube. The element 20 comprises four legs 14,15 similar to those in FIGS. 5 and 9. The legs 14,15 are disposed substantially parallel and in generally square array. The bridges 19 are disposed so that the two longer legs 14 are disposed side-by-side to one side of the square array. This disposition makes horizontal mounting of the element easier than other arrangements. Blocks 22,23 support the bridges 19 in the sleeve 21, block 23 also supporting the legs 14. Although a square array of the legs has been shown it will be appreciated that a rectangular array or other quadrilateral array may be used depending upon the application to which the element is to be put. The fixed relationship of the four legs of the element removes the risk that is present for conventional elements of the top set of elements dropping onto the lower set and causing a short-circuit. Because of this risk it is conventional only to use a single U-element in such horizontal installations.

Figure 8:
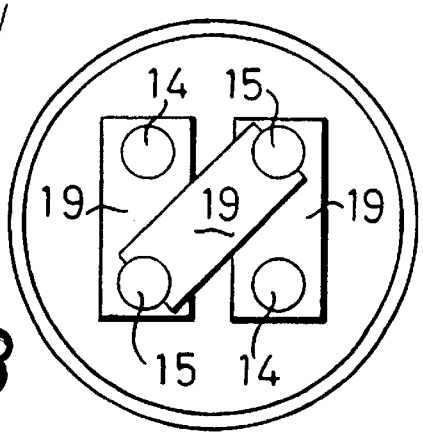
FIG. 8 is a plan view of a further four-legged, square array, electrical heater element in accordance with the present invention.

In FIG. 8 an alternative arrangement of bridges 19 is shown in which one of the bridges is disposed diagonally across the array. This means that the legs 14, to which electrical connection is made, are diagonally disposed. This arrangement is preferable to that of FIG. 7 for circumstances where the legs are intended to be disposed vertically.

Figure 10:
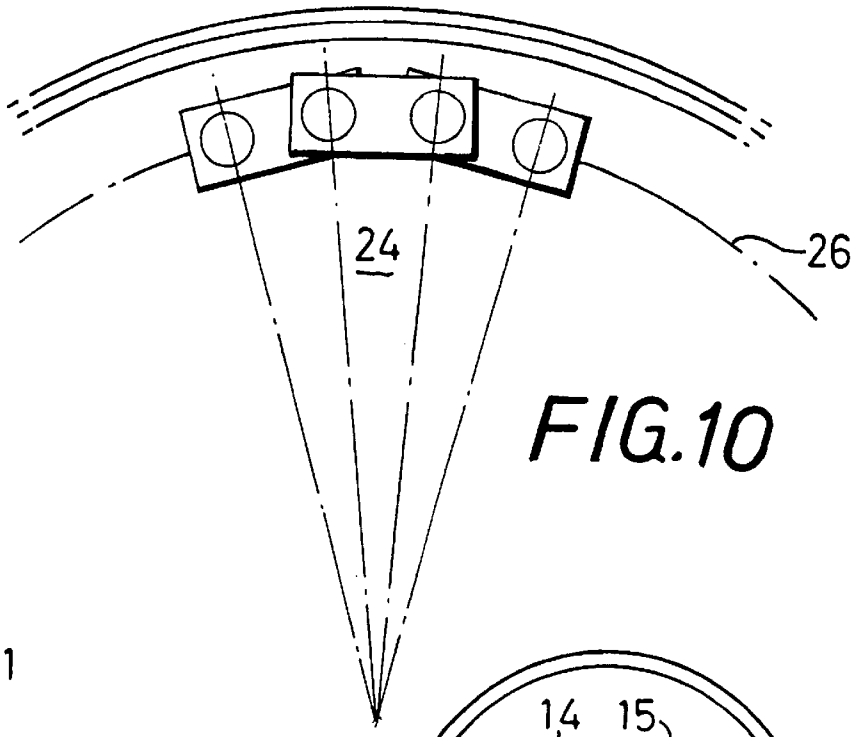
FIG. 10 is a plan view of a four-legged, curved array, electrical heater element in accordance with the present invention.

In FIG. 10 an element 24 is shown comprising four legs, disposed in parallel and on a curved array. A plurality of such curved elements may be used in the construction of a curved heating assembly (shown schematically as line 26), for example matching the curvature of a tubular furnace.

Figure 11:
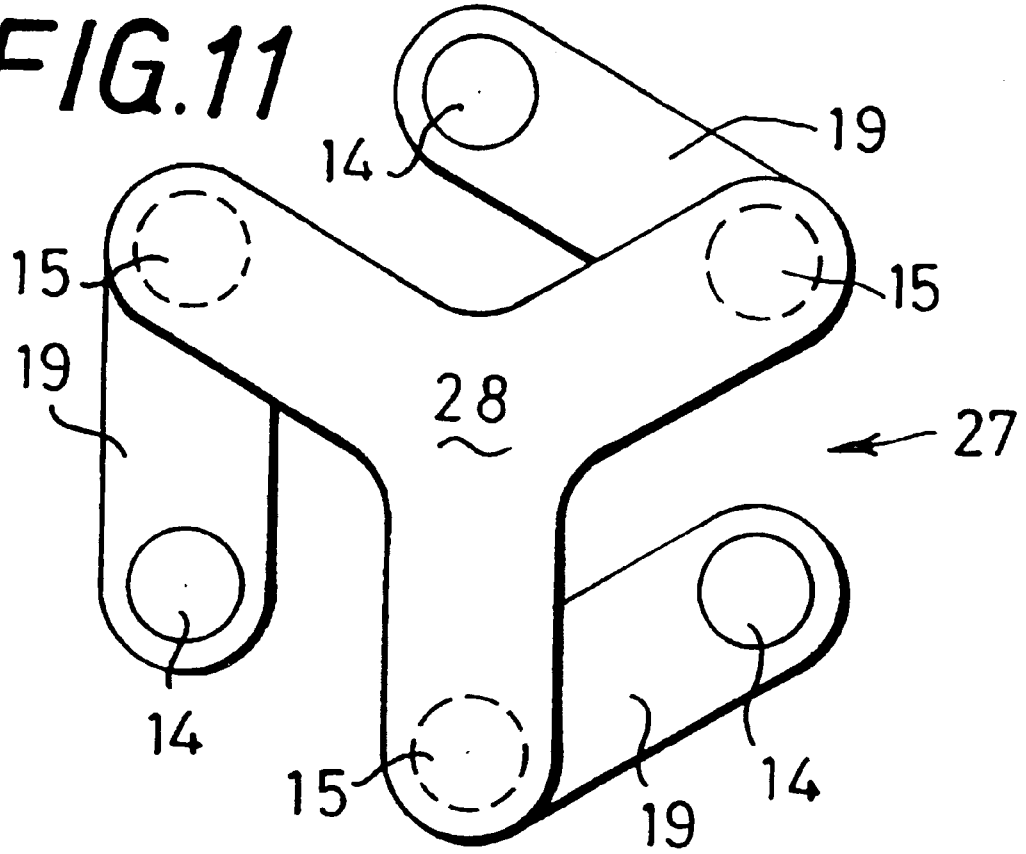
FIG. 11 is a plan view of a six-legged three-phase, electrical heater element in accordance with the present invention.

In FIG. 11 a three-phase element 27 is shown. The element 27 comprises 6 legs 14,15, legs 14 being longer than legs 15, the legs being disposed in a generally hexagonal array. Bridges 19 link the legs together in pairs of lone leg 14 and short leg 15. Bridge 28 links these pairs together. In use a three phase supply is connected to terminal portions of legs 14 and connected via legs 14, bridges 19, and legs 15 to bridge 28 which forms the star connection for the three phase arrangement. This arrangement has advantages over the conventional Tri-U arrangement (FIG. 3) which can require low voltages and high currents and hence requires an expensive power supply, especially when the hot zone is short, and/or the leg diameter is large. By going to six legs in series pairs the voltage will be higher since a similarly loaded. Tri-U element would have three legs of twice the diameter. For example, a Tri-U clement of 40 mm leg diameter with a hot zone length of 500 mm, might have a phase resistance of 0.4 Ω, and require a power supply rated at 50V (phase voltage) and 125A. In contrast a 3-phase 6-legged element as shown in FIG. 11 might have a phase resistance of 1.6 Ω, and require a power supply rated at 100V (phase voltage) and 62.5A; In summary, operating at about twice the voltage and half the current of the equivalent Tri-U.

All of the arrangements of FIGS. 5–11 are ones in which the number of terminals required is less than the number of legs of the element. This enables a lower number of connections to be used than in a conventional arrangement and reduces the number of holes that need to be provided in a furnace lining or insulation. Additionally, by providing a fixed arrangement of element legs it is possible to allow the element legs to be disposed closer together than in a conventional furnace since fear of element displacement and the consequent risk of short circuit is removed. This close disposition allows higher power densities to be achieved than with conventional arrangements. Bonding between the legs and the bridges is by any suitable method that will withstand the desired operating temperatures.

In all of the arrangements of FIGS. 5–11, an even number of element legs is used. This is convenient as it allows the terminals to lie to one side of the element, however the invention also contemplates an odd number of element legs with terminals disposed otherwise.

It should be noted that the thermal expansion characteristics of the legs are desirably matched to minimise movement of the bridging portions on heating of the elements. For example, referring to FIG. 6, if the legs 14 expand more than the legs 15 then the bridge 19 could be pulled out of block 23. By matching the thermal expansion characteristics of the legs 14 and 15 (for example by choice of the length of the hot zone 16, or by using materials of different thermal expansion coefficient) this risk can be reduced.

Alternatively, there are applications where it would be desirable to have long hot zones in some of the legs, to provide a background level of heating, with other legs being shorter than said hot zones, so providing additional localised heating. For example, in FIG. 5, if the hot zones 16 of legs 14 are longer than the legs 15 then a generalised level of heating would be provided by hot zones 16 with additional localised heating provided by legs 15.

As an application where such unequal hot zone lengths would be useful, it is standard practice in ceramic kilns to install higher power elements towards the base, with the objective of providing greater temperature uniformity.

Other applications where this type of unequal power distribution is used include electric ladle heaters, where typical designs may have ⅔ of the power in the lower half and ⅓ in the top half.

In the above description reference has been made to use of silicon carbide as a material for electrical heating elements. It should be apparent to the reader that the invention is applicable to use of any electrically conductive ceramic material. In this specification the term "electrically conductive ceramic" should be interpreted as meaning any non-metallic inorganic material that will conduct electricity to a sufficient extent, and have appropriate thermal properties, to be used as an electrical heating element.

What is claimed is:

1. An electrical resistance ceramic heating element comprising:

a) three or more ceramic legs comprising regions of the element in which at least the majority of the electrical heating occurs (hot zones), at least one of the legs being effectively entirely a hot zone and at least two of the legs each comprising a hot zone and a cold zone;

b) a number of leg terminal portions disposed adjacent cold zones and less than the number of legs, for connection to a power supply; and, c) ceramic bridging portions providing electrical connectivity between the legs.

2. An electrical resistance heating element as claimed in claim 1 in which the thermal expansion characteristics of the legs are matched to minimise movement of the bridging portions on heating of the elements.

3. An electrical resistance ceramic heating element as claimed in claim 2 and comprising four legs, two terminals, and three bridging portions.

4. An electrical resistance ceramic heating element as claimed in claim 1 and comprising four legs, two terminals, and three bridging portions.

5. An electrical resistance ceramic heating element as claimed in claim 4 in which the legs are substantially straight and parallel and disposed in a generally rectangular arrangement.

6. An electrical resistance ceramic heating element as claimed in claim 5 in which the terminals are diagonally disposed.

7. An electrical resistance ceramic heating element as claimed in claim 6 in which the legs are disposed in a generally square arrangement.

8. An electrical resistance ceramic heating element as claimed in claim 5 in which the terminals are disposed side-by-side along one side of the rectangular arrangement.

9. An electrical resistance ceramic heating element as claimed in claim 8 in which the legs are disposed in a generally square arrangement.

10. An electrical resistance ceramic heating element as claimed in claim 5 in which the legs are disposed in a generally square arrangement.

11. An electrical heating element as claimed in claim 1 in which the legs are substantially straight and parallel and disposed in an arc whereby a plurality of such elements may be used to form a curve.

12. An electrical resistance ceramic heating element as claimed in claim 1 and comprising a bridge connecting at least three legs and acting as the star connector for a three-or-more phase power supply.

13. An electrical resistance ceramic heating element as claimed in claim 12 in which there are six legs, three terminals, and four bridging portions, one of the bridging portions acting as the star connector for a 3-phase power supply.

14. An electrical resistance heating element as claimed in claim 1 in which the hot zones in some of the legs are longer than the hot zones in other of the legs whereby, in use, the hot zones in said some of the legs provide a background level of heating, with said other legs providing additional localized heating.

* * * * *